US007928309B2

(12) United States Patent
Vallancourt et al.

(10) Patent No.: US 7,928,309 B2
(45) Date of Patent: Apr. 19, 2011

(54) SCAT GUITAR SIGNAL PROCESSOR

(75) Inventors: David Vallancourt, Red Bank, NJ (US); Menachem Gielchinsky, Elizabeth, NJ (US); Ezra Flug, Teaneck, NJ (US)

(73) Assignee: The Trustees of Columbia University in the City of New York, New York, NY (US)

( * ) Notice: Subject to any disclaimer, the term of this patent is extended or adjusted under 35 U.S.C. 154(b) by 199 days.

(21) Appl. No.: 12/105,150

(22) Filed: Apr. 17, 2008

(65) Prior Publication Data

US 2008/0289481 A1 Nov. 27, 2008

Related U.S. Application Data

(60) Provisional application No. 60/912,926, filed on Apr. 19, 2007.

(51) Int. Cl.
*G10H 1/00* (2006.01)
*G10H 1/18* (2006.01)

(52) U.S. Cl. ..... 84/615; 84/600; 84/603; 84/616; 84/653; 84/654

(58) Field of Classification Search ..... None
See application file for complete search history.

(56) References Cited

U.S. PATENT DOCUMENTS

| | | | | |
|---|---|---|---|---|
| 3,987,484 | A * | 10/1976 | Bosche et al. | 386/69 |
| 4,322,718 | A * | 3/1982 | Faierstain | 367/197 |
| 4,622,553 | A * | 11/1986 | Baba et al. | 342/91 |
| 4,633,234 | A * | 12/1986 | Gagnon | 340/566 |
| 4,841,827 | A * | 6/1989 | Uchiyama | 84/622 |
| 5,018,427 | A * | 5/1991 | Uchiyama | 84/603 |
| 5,024,134 | A * | 6/1991 | Uchiyama | 84/654 |
| 6,405,093 | B1 * | 6/2002 | Malcolm, Jr. et al. | 700/94 |

* cited by examiner

*Primary Examiner* — Marlon T Fletcher
(74) *Attorney, Agent, or Firm* — Baker Botts LLP

(57) ABSTRACT

The disclosed subject matter includes, in one aspect, a signal processor having circuitry configured to substitute an assortment of pre-recorded sounds in place of the sound of the guitar. The pre-recorded sounds are triggered by a guitar note that is above a certain threshold. The threshold can be varied, as can the length of time of the substitution.

21 Claims, 5 Drawing Sheets

SCAT GUITAR SIGNAL PROCESSOR

CROSS REFERENCE TO RELATED APPLICATIONS

This application claims the benefit of prior filed U.S. Provisional Patent Application No. 60/912,926, filed Apr. 19, 2007, the entirety of which is incorporated herein by reference.

BACKGROUND

The disclosed subject matter relates to guitar signal processors, means for processing sound, and program storage means readable by a computer to process an input sound, and more particularly pertains to a new guitar signal processor that can substitute pre-recorded sounds in place of the sound of the guitar.

BACKGROUND ART

Electric guitar amplifiers were introduced in the 1940s and for decades their basic design remained relatively unchanged. These analog amplifiers evolved to add tone controls, channel switching, and analog effects including reverb and tremolo, and later digital effects such as chorus. Yet the core guitar system has remained: an electric guitar connected to an amplifier and then to a loudspeaker for broadcasting sound after an audio signal from the electric guitar is processed by the amplifier. If the guitarist wanted a different sound, he would use a different guitar, amplifier, or loudspeaker.

Eventually, guitar players began inserting additional effects produced by other signal processing devices into the signal chain from the guitar to the loudspeakers to obtain a wider variety of tonal characteristics or sound effects. The first and simplest guitar effects processing devices were analog pedals inserted between the guitar and the amplifier. As they evolved, a variety of both analog and digital signal effects were available to the musician either as a floor pedal or a rack mounted signal processing device. Such effects pedals and rack processors added variety in tonal possibilities that were used by many guitarists to provide a plethora of effects using processors between their guitar and amplifier.

A wide range of effects processors exist for producing traditional guitar effects, such as reverb, chorus, distortion, and flanging to name a few, as well as variations on the traditional effects. No fundamentally new effect, however, has been introduced since the 1970's.

There is a need for a sound effects processor that can be configured to receive a live input signal from an instrument, and output a substituted pre-recorded sound.

SUMMARY

The disclosed subject matter provides a guitar effects processor configured to receive an input signal from a guitar, and output a substituted pre-recorded sound.

The processor enables smooth switching between guitar and pre-recorded sounds.

In some embodiments, the circuitry is compact enough to be encased in a guitar pedal casing, and includes a pedal to control which pre-recorded sound to substitute.

In some embodiments, the disclosed subject matter includes a signal processor having circuitry configured to substitute an assortment of pre-recorded sounds in place of the sound of the guitar. The pre-recorded sounds are triggered by a guitar note that is above a certain threshold. The threshold can be varied, as can the length of time of the substitution.

DETAILED DESCRIPTION

Reference will now be made in detail to the presently preferred embodiments of the disclosed subject matter, examples of which are illustrated in the accompanying drawings.

The sound processor can include circuitry to receive, analyze, and output sound signals or can include a computer system implementing program instructions stored on program storage means that instruct the computer system to substitute pre-recorded sounds for an input sound accordingly.

Figure 1:
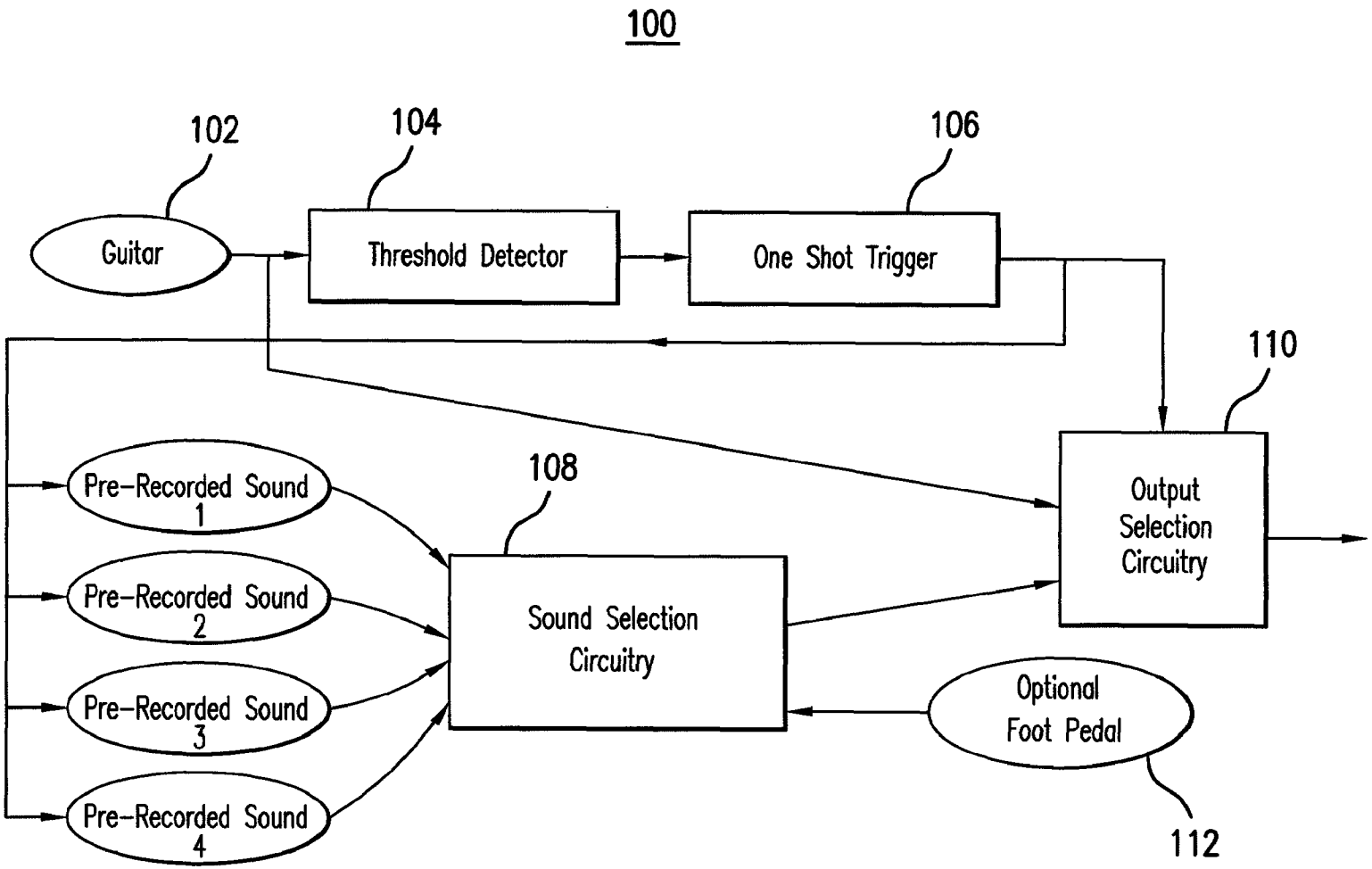
FIG. 1 is a block diagram of the operation of the signal processor according to some embodiments of the disclosed subject matter.

As shown in FIG. 1, the sound processor 100 of the disclosed subject matter receives input from an attached guitar 102. The threshold detection means 104 of the sound processor can be triggered if the input voltage from the guitar is above a certain threshold level. Alternatively, the sound processor 100 can be configured to use current rather than voltage to perform the signal processing, in which case, the threshold detection means 104 can be triggered if the input current from the guitar is above a threshold level.

When triggered by a guitar input above the threshold level, the threshold detection means 104 sends a pulse in the form of a digital "1" to a one-shot timer 106. Upon receipt of the pulse, the one-shot timer 106 triggers the playing of a pre-recorded sound by triggering sound-selection means 108 to select a sound to be played, and simultaneously triggering output selection means 110 to switch from outputting sound from the guitar to outputting sound from the sound-selection means 108. Alternatively, one-shot timer 106 can be replaced by a digital counter that in turn triggers the sound-selection means 108.

Figure 2:
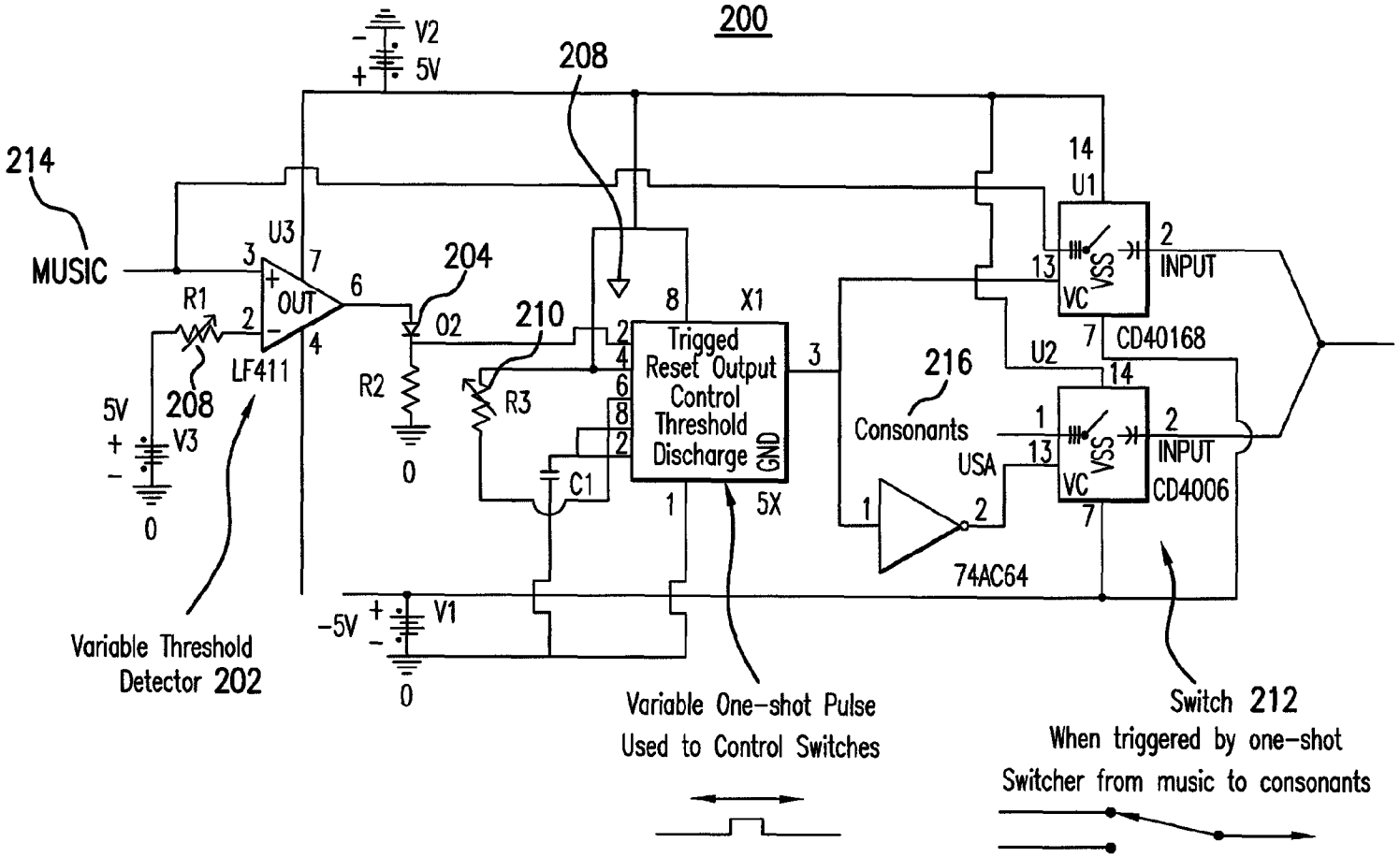
FIG. 2 is a circuit diagram of a signal processor according to some embodiments of the disclosed subject matter.

FIG. 2 shows a circuit diagram of the sound processor 200 of an embodiment of the disclosed subject matter. A threshold detector 202 can be an LF411 Op-Amp, attached diode 204, and potentiometer 206. When the input voltage from the guitar is below the threshold voltage, the threshold detector output voltage is ground instead of a negative voltage because of the diode 204. When the input from the guitar exceeds the threshold voltage, the detector output voltage is equal to the positive supply voltage.

According to an aspect of the disclosed subject matter, the threshold voltage can be changed by varying the potentiometer 206.

In accordance with one embodiment of the disclosed subject matter, the one-shot timer circuit 208 is a 555 timer. In this embodiment, the timing of the one-shot pulse is determined by the external resistor and capacitor. Also, a potentiometer 210 is used instead of a regular resistor in order to enable a user to change the length of the one-shot pulse.

For example, in one embodiment, the potentiometer 210 can vary the one-shot pulse between approximately 60 ms and 140 ms.

The output selection circuit 212 can operate as a switch. In one mode the output selection circuit 212 outputs the signal directly from the guitar 214. In another mode, the output selection circuit outputs the signal from the sound selection circuit 216.

In accordance with one embodiment of the disclosed subject matter, the output selection circuit 212 includes two CD4066 analog switches whose control voltages are the one-shot pulse and an inversion of the one-shot pulse. When the input from the guitar exceeds the threshold and the one-shot timer outputs a one-shot pulse, the output selection circuit 212 switches allow the signal from the sound selection circuit 216 to pass through and do not allow the signal from the guitar 214 through.

In accordance with one aspect of the disclosed subject matter, pre-recorded sounds can be stored for selection and playback in the sound selection circuit 216. The pre-recorded sounds can be stored using an analog sound recording integrated circuit, such as, for example, the ISD1100 series integrated circuit. The pre-recorded sounds can also be stored on a digital memory chip such as, for example, an EEPROM, which would then require a digital-to-analog converter to play the sound in analog form. Alternatively any suitable devices and methods of recording and storing sounds for selection and playback can be used.

In accordance with one embodiment of the disclosed subject matter, sound selection means 108 as shown in FIG. 1, can be a multi-pole switch controlled by a foot pedal 112. The multi-pole switch is connected to the various pre-recorded sounds. The foot pedal 112 can control which pre-recorded sound the multi-pole switch connects to the output selection means 110.

In accordance with another embodiment of the disclosed subject matter, the sound selection means 108 can include a foot pedal 112 that controls a potentiometer that has a voltage across it. The output voltage of the potentiometer can be controlled by the tap of the foot pedal 112 and can be detected using a set of comparators of different threshold voltages, which in turn make the switch selection to determine which pre-recorded sound is connected to the output selection means 110.

Figure 3:
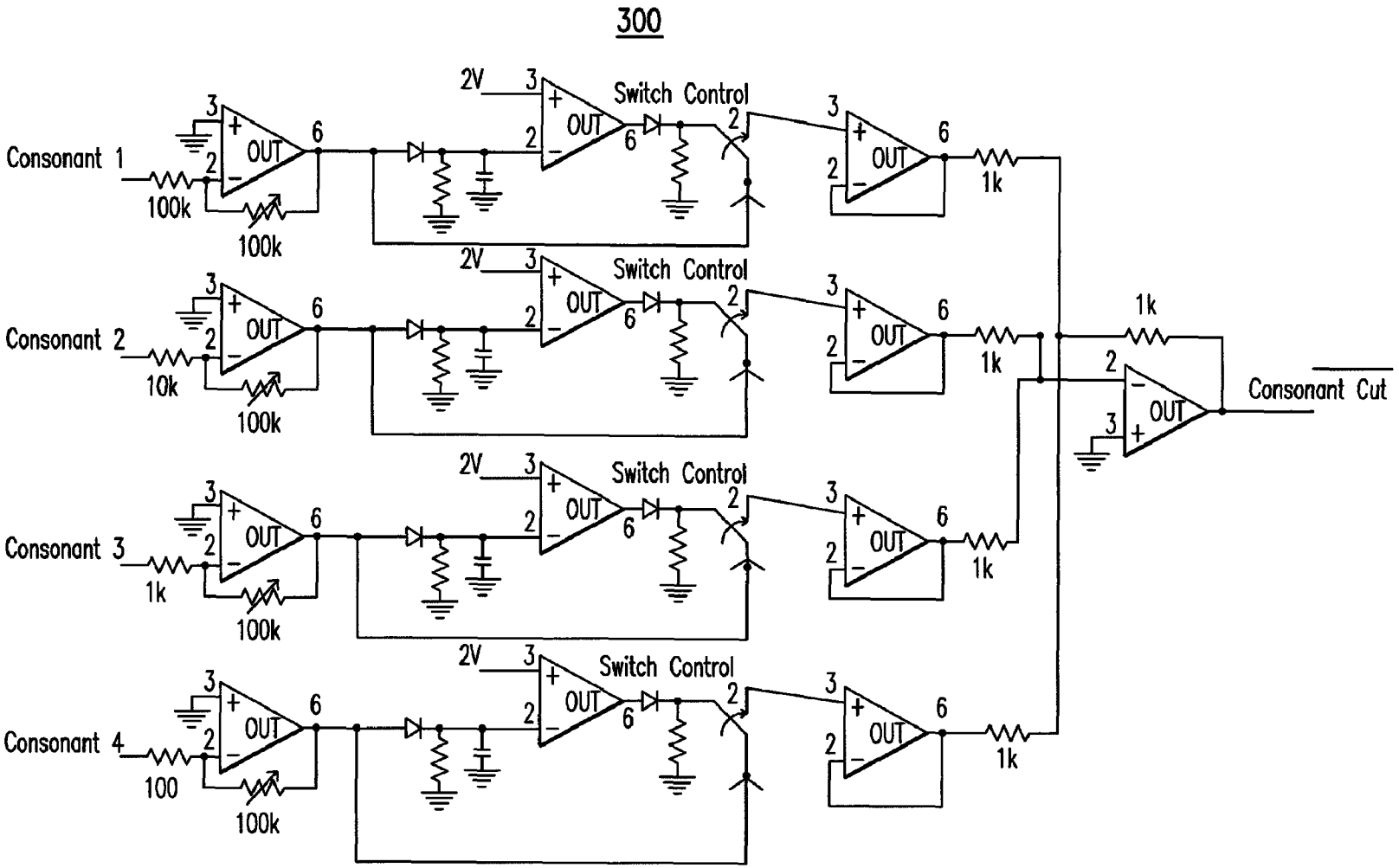
FIG. 3 is a circuit diagram of a sound selection circuitry according to some embodiments of the disclosed subject matter.

In one embodiment of the disclosed subject matter, as shown in the circuit diagram of FIG. 3, the sound selection circuit 300 is a weighted summer circuit.

In this embodiment, the sound selection circuit 300 can be controlled by a ganged set of potentiometers, actuated by a pedal. This arrangement can act as an analog mixer, as shown by the circuit diagram of FIG. 3. Alternatively, the pedal-controlled potentiometers can act as a discrete selection means. Additionally, the weighted summer circuit may be implemented by any other means known in the art in order to create a smooth transition between adjacent sounds.

As shown in FIG. 3, the sound selection circuit 300 functions by unequally weighting all of the sounds and summing them together, making one sound prevail over the others. However, as the a knob for the potentiometer or, alternatively the pedal ("the knob" collectively), is turned, the gain of each of the sounds is increased until the loudest one reaches a certain threshold where it gets cut off, making the next loudest sound prevail. This continues as the knob is turned for each of the sounds.

As shown in FIG. 3, in one embodiment of the disclosed subject matter, there can be four pre-recorded sounds. However, any number of suitable pre-recorded sounds may be used, including enough to cover all of the non-voiced consonants of a given human language.

As shown in FIG. 3, in one embodiment of the disclosed subject matter, the first stage of the sound selection circuit 300 includes the pre-recorded sounds each being input into an Op-Amp with input resistors that are greater for each successive pre-recorded sound. In accordance with a one embodiment, each successive input resistor is 10 times greater than the previous resistor.

As shown in FIG. 3, the feedback resistor for each Op-Amp in the sound selection circuit can be a potentiometer, which can be connected to the same control knob. The Op-Amp with the smallest input resistor will always produce a gain that is at least ten times greater than all of the others.

Further as shown in FIG. 3, the second stage of the sound selection circuit can be a threshold detector, the detector has a threshold of 2V. Other suitable thresholds may be used.

The second stage of the sound selection circuit functions to signal when to switch off a particular pre-recorded sound. The third stage of the sound selection circuit can be a switch to shut off a particular sound. Following the switch for each sound can be a buffer and a weighted summer circuit to combine all of the sounds.

Figure 4:
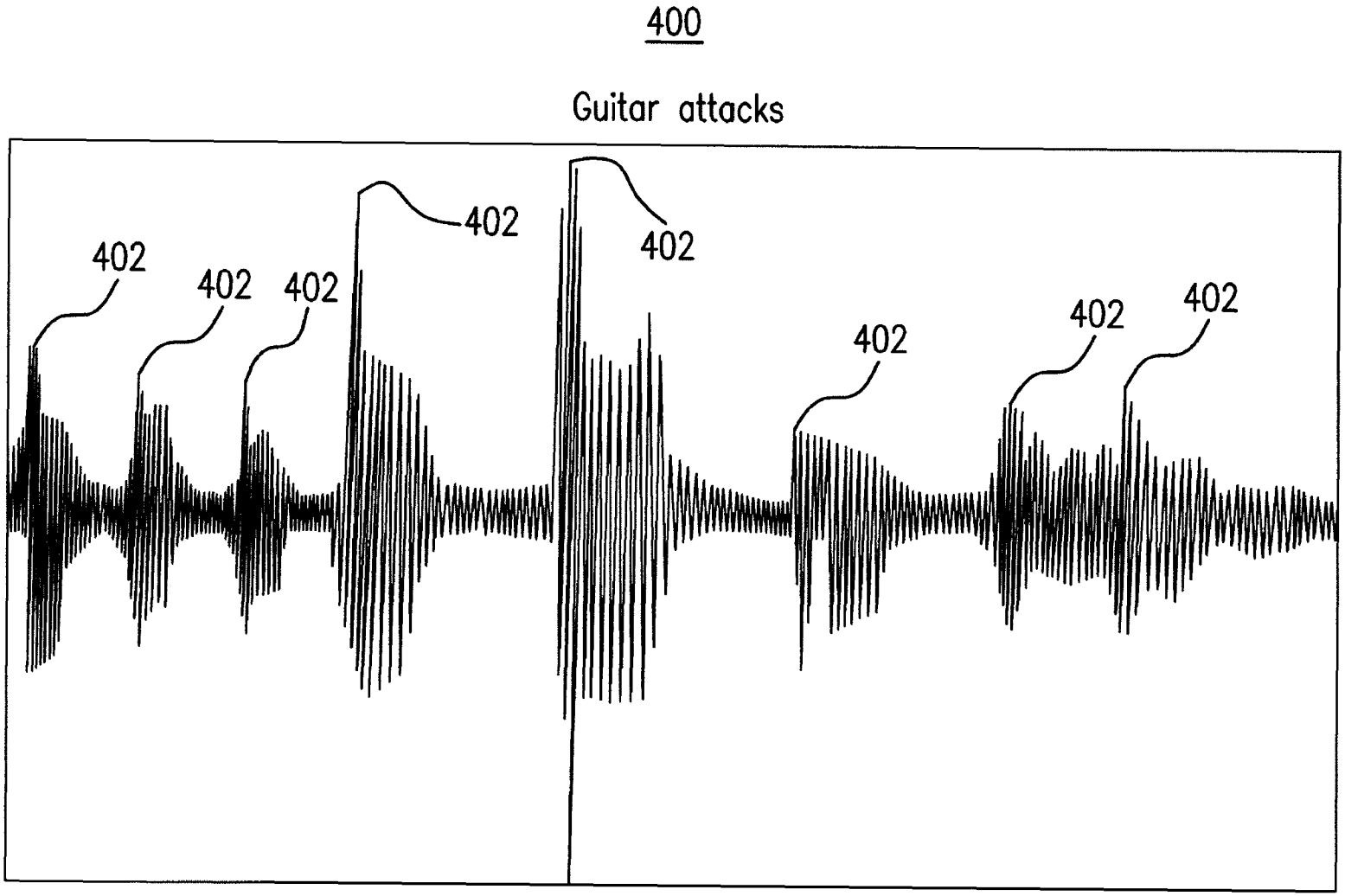
FIGS. 4 and 5 are waveform simulations according to some embodiments of the disclosed subject matter.

FIG. 4 is a waveform 400 depicting voltages from a guitar to be input into a sound processor of the disclosed subject matter. The peaks 402 are points where the voltage exceeds a threshold voltage.

Figure 5:
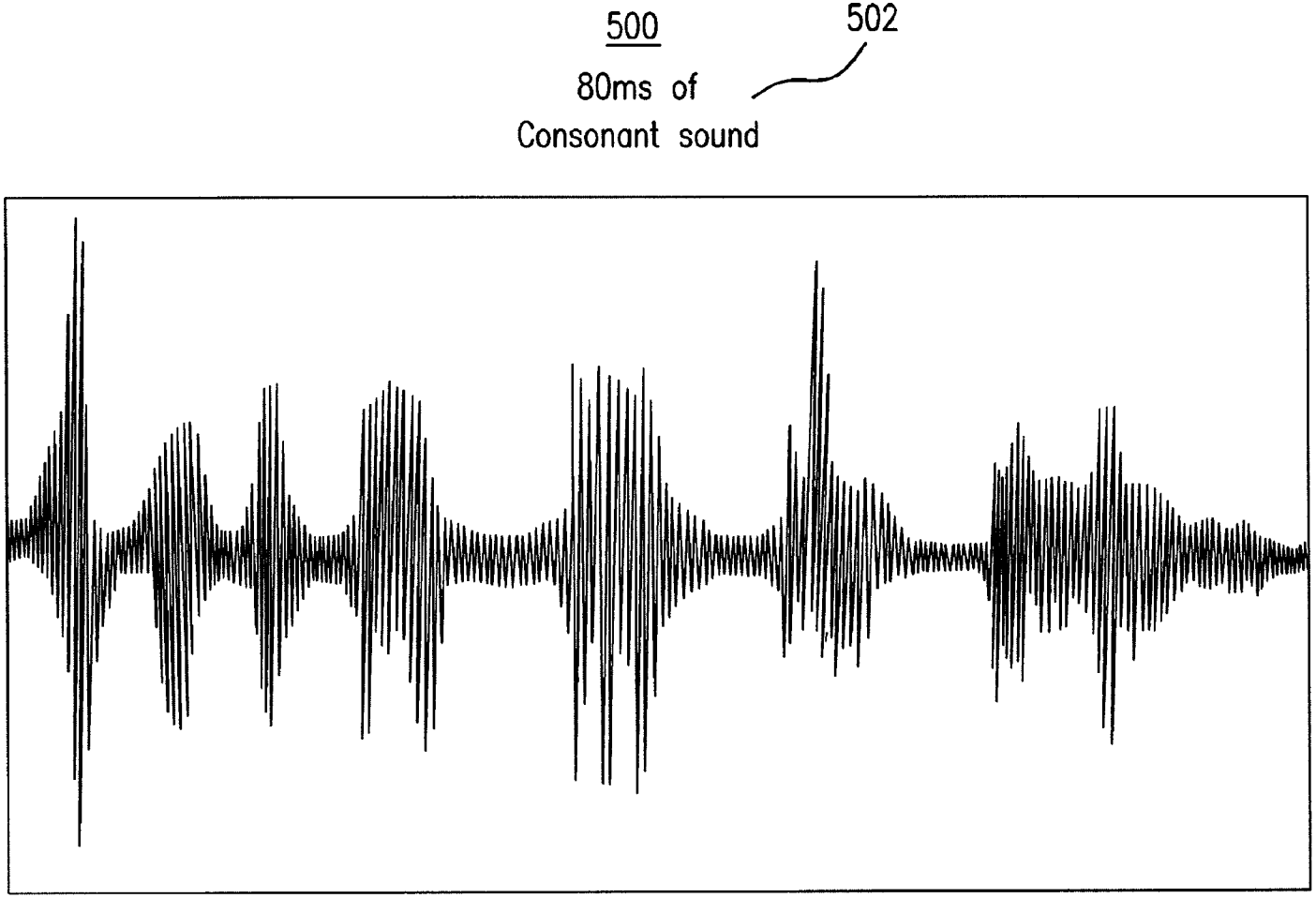

FIG. 5 is a waveform simulation 500 showing the playing of a pre-recorded sound each time a threshold was exceeded. One such event, shown as peak 502 depicts 80 ms of pre-recorded sound being played.

In an embodiment of the disclosed subject matter the effect substitution circuitry may be disable for a controllable time period after it is triggered and makes the sound substitution, thus preventing stuttering of the substituted sound. Disabling the substitution circuitry may be accomplished in any manner known in the art. As an example and not a limitation upon the present invention, disabling the substitution circuitry may be accomplished by increasing the threshold to a level such that no possible input signal could exceed it, thereby effectively blocking another trigger until the threshold is reduced. The duration of such a blocking may be adjustable by, for example, using an RC circuit with the resistor being a potentiometer.

In accordance with another embodiment of the disclosed subject matter, in order to preserve some of the distinctive sound of a guitarist's style while incorporating a pre-recorded effect, one of the sound selection means 108 and output selection means 110 can include circuitry configured to monitor the amplitude of the input guitar signal and modify the amplitude of the output pre-recorded sound to match the amplitude of the input guitar signal.

In accordance with yet another embodiment of the disclosed subject matter, a program storage means readable by a computer can store a program of instructions executable by the computer to substitute one or more pre-recorded sounds for a live sound upon receipt of an input signal sound. The program instructs the computer to receive an input sound signal as from a guitar or other input device, compare the input sound signal to a threshold value, and select a pre-recorded sound stored in memory and output the selected pre-recorded sound when the input sound signal exceeds the threshold. This program software can be stored on any program storage means or computer readable media such as a diskette, a hard disk, random-access-memory, solid state memory, or any other computer readable media.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents.

What is claimed is:

1. A sound processor for substituting one or more pre-recorded sounds for a live sound upon receipt of an input signal sound, comprising:

a threshold detector circuit configured to receive the input sound signal, compare the input signal to a threshold, and output a trigger signal if the input sound signal exceeds the threshold;

a timer circuit configured to receive the trigger signal and output a one-shot pulse of a first duration;

a sound selection circuit configured to receive the one-shot pulse and select and output one of the one or more pre-recorded sounds; and an output selection circuit configured to receive the one-shot pulse and select and output an output signal from the at least one pre-recorded sound and the input signal.

2. The sound processor of claim 1 wherein the at least one pre-recorded sound is a consonant sound.

3. The sound processor of claim 1 wherein the one-shot pulse is from about 60 ms to about 140 ms long.

4. The sound processor of claim 1 further comprising a data storage configured to store the one or more pre-recorded sounds.

5. The sound processor of claim 4 wherein the data storage is at least one analog sound recording integrated circuit.

6. The sound processor of claim 4 wherein the data storage is a digital memory chip.

7. The sound processor of claim 1 wherein the threshold can be varied.

8. The sound processor of claim 1 wherein the first duration can be varied.

9. The sound processor of claim 1, further comprising an output modulation circuit configured to monitor an amplitude of the input sound signal, receive the one or more pre-recorded sounds, and modulate an amplitude of the received one or more pre-recorded sounds to match the amplitude of the input sound signal.

10. The sound processor of claim 1, further comprising a foot pedal, wherein the sound selection circuit comprises a multi-pole switch connected to the one or more pre-recorded sounds and the foot pedal and configured to receive an input from the foot pedal and output one of the one or more pre-recorded sounds.

11. The sound processor of claim 1, further comprising:

a foot pedal configured to output a signal, wherein the sound selection circuit comprises a potentiometer having an input voltage and configured to receive the signal and output an output voltage based upon the signal;

the sound selection circuit further comprising one or more comparators configured to receive the output voltage and select and output one of the one or more pre-recorded sounds based upon the received output voltage.

12. A sound processor for substituting one or more pre-recorded sounds for a live sound upon receipt of an input signal sound, comprising:

threshold detection means for receiving the input sound signal, comparing the input signal to a threshold, and outputting a trigger signal if the input sound signal exceeds the threshold;

timing means for receiving the trigger signal and outputting a pulse of a first duration;

sound selection means for receiving the pulse and select and outputting one of the one or more pre-recorded sounds; and output selection means for receiving the pulse and selecting and outputting an output signal from the at least one pre-recorded sound and the input signal.

13. The sound processor of claim 12 wherein the at least one pre-recorded sound is a consonant sound.

14. The sound processor of claim 12 wherein the pulse is from about 60ms to about 140ms long.

15. The sound processor of claim 12 further comprising data storage means for storing the one or more pre-recorded sounds.

16. The sound processor of claim 15 wherein the data storage means is at least one analog sound recording integrated circuit.

17. The sound processor of claim 15 wherein the data storage means is a digital memory chip.

18. The sound processor of claim 12 further comprising means for varying the threshold.

19. The sound processor of claim 12 further comprising means for varying the first duration.

20. The sound processor of claim 12, further comprising means for modulating the output signal configured to monitor an amplitude of the input sound signal, receive the one or more pre-recorded sounds, and modulate an amplitude of the received one or more pre-recorded sounds to match the amplitude of the input sound signal.

21. The sound processor of claim 12, further comprising secondary input means, wherein the sound selection means is configured to receive an input from the secondary input means and output one of the one or more pre-recorded sounds based upon the input from the secondary input means.

* * * * *